United States Patent [19]

Adams

[11] Patent Number: 4,721,121

[45] **Date of Patent: * Jan. 26, 1988**

[54] COMBINATION PRESSING COMB DRYER AND BLOW DRYER

[76] Inventor: Charles R. Adams, 1932 W. 25th St. #12, Los Angeles, Calif. 90018

[ * ] Notice: The portion of the term of this patent subsequent to Feb. 18, 2003 has been disclaimed.

[21] Appl. No.: 829,503

[22] Filed: Feb. 14, 1986

Related U.S. Application Data

[63] Continuation-in-part of Ser. No. 672,126, Nov. 16, 1984, Pat. No. 4,570,651.

[51] Int. Cl.[4] ..... A45D 20/00

[52] U.S. Cl. ..... 132/9; 219/370

[58] Field of Search ..... 132/9, 11 A; 219/370, 219/373; 34/15, 92.91

[56] References Cited

U.S. PATENT DOCUMENTS

| | | | |
|---|---|---|---|
| 1,033,122 | 7/1912 | Schwartz | 132/37 R |
| 1,252,499 | 1/1918 | Scheel | 132/37 R |
| 1,376,416 | 5/1921 | Forshee | 132/37 R |
| 2,753,434 | 7/1956 | Storm, Jr. | 34/97 UX |
| 3,613,257 | 10/1971 | Yashiike et al. | 34/97 |
| 3,903,905 | 9/1975 | Tucker | 132/9 |
| 3,943,329 | 3/1976 | Hlavac | 219/370 |
| 3,981,314 | 9/1976 | Burradas | 132/9 |
| 4,139,014 | 2/1979 | Rowland | 219/373 |
| 4,210,162 | 7/1980 | Dreyer | 132/9 |
| 4,479,516 | 10/1984 | Hunter | 132/11 A |

*Primary Examiner*—Gregory E. McNeill

*Attorney, Agent, or Firm*—Erik M. Arnhem

[57] ABSTRACT

An elongated cylindrical housing supports a comb structure on one end and an air nozzle on the other. A reversible electrically driven fan is supported within the housing and produces an air flow through the comb, the housing and the nozzle in either direction. Means are provided for heating the air passing through the housing and the comb.

5 Claims, 2 Drawing Figures

100
101
102
104
105
106
107
108
109
110
111
112
113
114
115
116
117
6

118
119
120
121
122
124
125
126
127
128
129
130
131
132
133
135
137
138
139
140
141
144
145
146
147
148
149
150
151
152
153
154
155
156
157
158
159

COMBINATION PRESSING COMB DRYER AND BLOW DRYER

CROSS-REFERENCES TO RELATED APPLICATIONS

This application is a continuation-in-part of copending application number 06/672,126 filed Nov. 16, 1984, now U.S. Pat. No. 4,570,651 and having the same inventor as this application.

BACKGROUND OF THE INVENTION (1) Field of the Invention

This invention relates generally to hair styling devices and particularly to those used to style tightly curled or "kinky" hair.

(2) Prior Art

It has been found by practitioners in the art of hair styling that persons with tightly curled or kinky hair present substantial problems in hair styling. Typically, styling the hair of a person with such tightly curled or kinky hair requires an initial step of shampooing and drying the hair. Generally, a heated pressing comb is repeatedly drawn through the hair to straighten the hair. After the hair is straightened, a hair style is imparted using curling irons and setting techniques typical of other styling procedures. Frequently, the method used in styling tightly curled or kinky hair necessitates the use of four separate devices (a blow dryer, a heater, a pressing comb and curling irons) to produce a total hair style. This represents substantial difficulty and expense to persons seeking to perform hair styling upon individuals having such tightly curled or kinky hair.

The foregoing problems associated with hair styling tightly curled hair have led practitioners in the art to develop devices which aid in styling such tightly curled hair.

While the foregoing described devices provide some beneficial operation in hair styling and drying, there remains a need in the art for a compact, effective, easy-to-use pressing comb and blow dryer which may be manufactured at a low cost and which is easy to use by hair stylists.

Examples of two such devices are set forth in U.S. Pat. No. 3,847,166 and U.S. Pat. 4,314,405.

U.S. Pat. 3,847,166 illustrates a hair shaper in which a heated comb structure is designed to cooperate with and nest within a heat conductive shaping board. The latter has a generally curved structure suitable for being passed over the subject's hair and applying heat thereto while the friction between the hair and the curved surface draws the curly hair to a more straight orientation. Once the hair is drawn straight, the heat tends to set the hair in its straightened configuration.

U.S. Pat. 4,314,405 set forth a hair cutting device which includes a reversible motor and heating element disposed within a housing having a central passage extending therein. The general appearance of the device resembles a conventional blow-dryer. A fan within the housing is capable of being driven in a suction mode by activation of a drive motor. In the suction mode, hair is drawn into the housing and brought into contact with a plurality of hair cutting impeller blades whereby the hair is cut at a predetermined length defined by the extension of the housing. In addition, the direction of fan motion may be reversed to a blower mode and a heater activated which produces a more conventional blower dryer operation.

SUMMARY OF THE INVENTION

Accordingly, it is a general object of the present invention to provide an improved hair styling apparatus. It is more particular object of the present invention to provide an improved hair styling apparatus which is particularly adapted to use with tightly curled or kinky hair. It is a still more particular object of the present invention to provide an improved hair styling apparatus suitable for use on any texture of hair, and particularly on tightly curled or kinky hair which is housed in a single multi-function, housing and which is easy to manipulate by a hair stylist.

In accordance with the present invention there is provided a combination pressing comb and blow dryer in which an elongated generally cylindrical housing defining a longitudinal air passage therethrough supports a reversible electrically driven fan and a plurality of electric heaters positioned within the air stream.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings in the several figures of which like reference numerals identify like elements, and in which:

DESCRIPTION OF THE PREFERRED EMBODIMENTS

Figure 1:
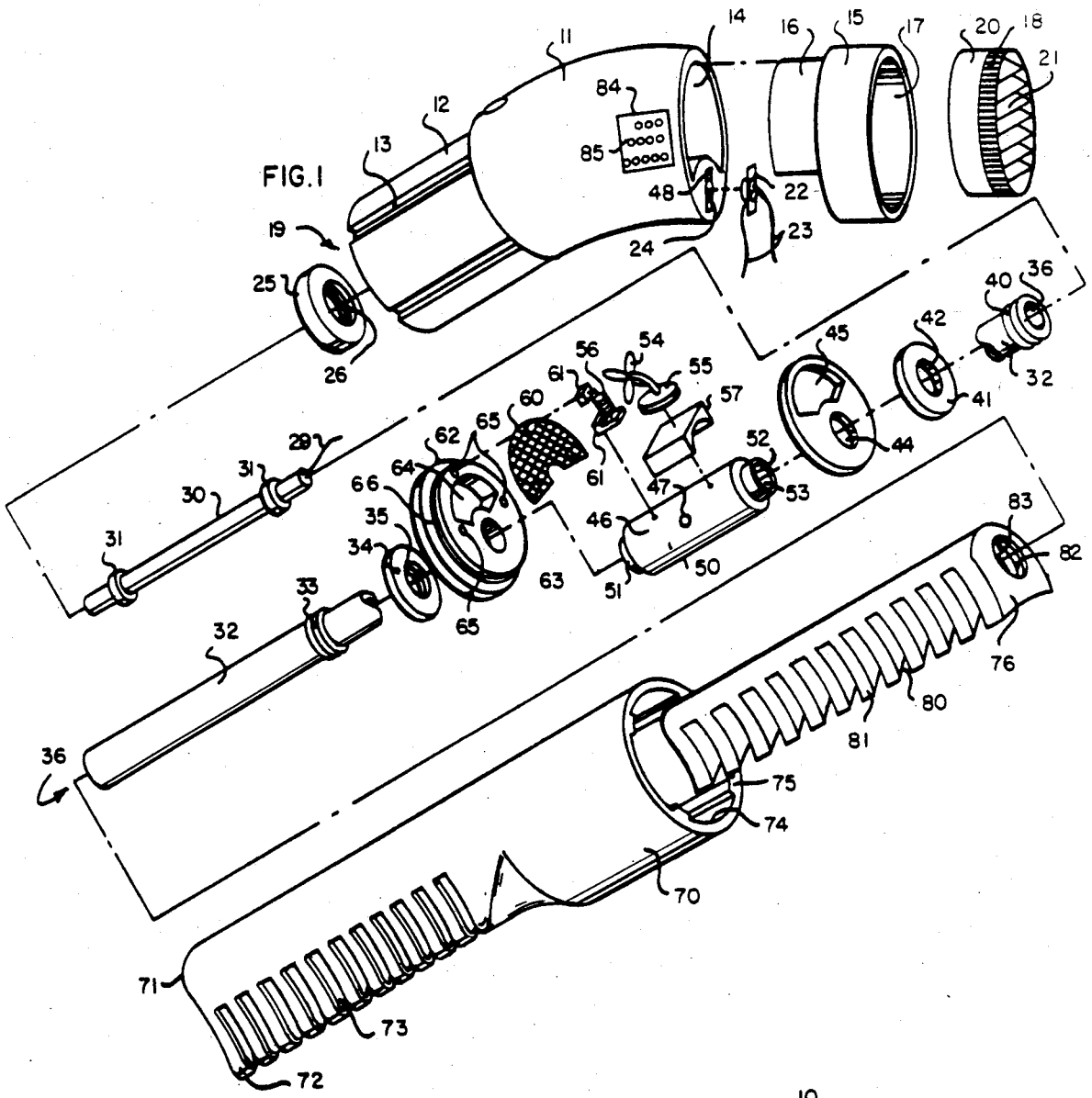
FIG. 1 is an assembly view in perspective of a combination pressing comb and hair dryer constructed in accordance with the present invention.

FIG. 1 sets forth an assembly view of a combination pressing comb and hair dryer constructed in accordance with the present invention. A first plurality of teeth are configured on one end of the device and are separated by a plurality of serrations aligned with grooves 13 to insure proper alignment of interior pressing comb 76 with respect to exterior comb 71. Thereafter, handle extension 12 is fully inserted into extension cavity 74 and the resulting assembly is completed by securing interior comb 76 within comb cavity 90 by using a fastener 91 As is shown more clearly in FIG. 4, fastener 91 is passed through an aperture 93 defined in exterior comb 71 and is received by a threaded aperture 92 in interior comb 76.

It will be understood by those skilled in the art that the foregoing mechanical structure and assembly may be varied without departing from the spirit and scope of the present invention. it will be further understood by those skilled in the art that the foregoing assembly will further include the steps required to complete the appropriate electrical connections between primary heating element 30, fan motor 55, secondary heater 56, receptacle 24 and control face 84. The latter is shown more clearly in FIG. 2.

Figure 2:
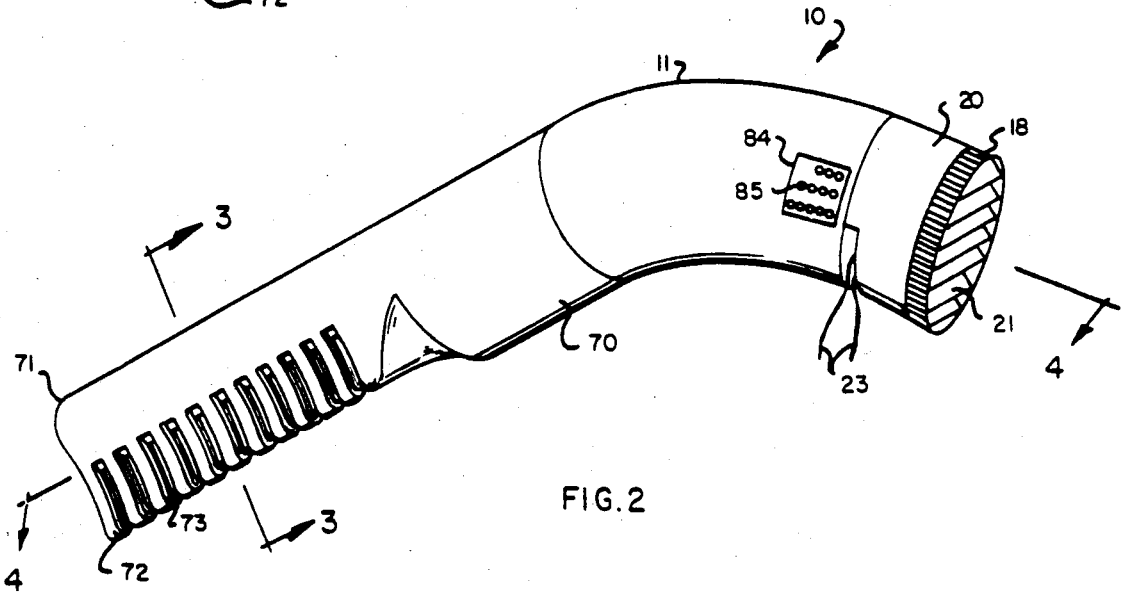
FIG. 2 is a perspective view of the assembled combination hair dryer and pressing comb of FIG. 1.

FIG. 2 shows the exterior view in perspective of the completed structure of the present invention combination pressing comb and blow dryer. As is shown in FIG. 2, handle 11 further defines a control face 84. A plurality of controls 85 are supported upon control face 84 by appropriate electrical connections (not shown) provide the coupling of electrical power between wires 23 and primary heating element 30, secondary heater 56, and fan motor 55 to accomplish the below described operations. Examination of FIG. 2 shows an important advantage of the present invention structure. Because the resulting structure is a single unitary device having a comb structure at one end of its generally elongated configuration, an air nozzle at the other end and a convenient handle therebetween, the general shape is one which permits manipulation convenient in one hand by a hair stylist.

Figure 3:
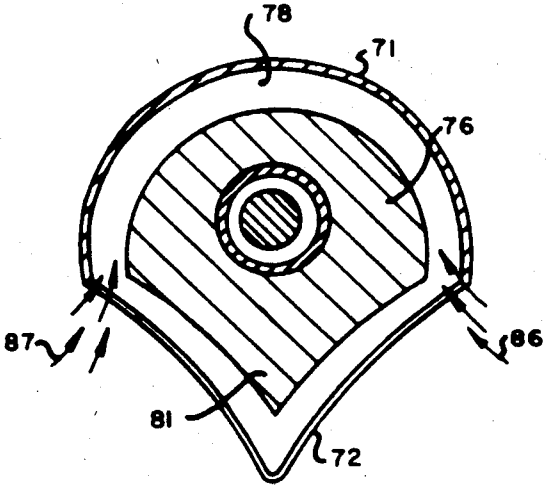
FIG. 3 is a section view of the present invention combination pressing comb and hair dryer taken along section lines 3—3 in FIG. 2.

FIG. 3 shows a cross section of the present invention dryer comb taken through section lines 3—3 in FIG. 2. As can be seen, interior comb 76 is supported within comb cavity 90 in a manner creating an air space 78 surrounding interior comb 76 within exterior comb 71. As mentioned above, the serrations 73 and 80 in exterior comb 71 and interior comb 76 respectively are maintained in substantial alignment with the result that an air passage into air space 78 is created. Also shown in FIG. 3 the relationship between primary heating element 30 and interior comb 76 is such that heat produced by the former is communicated to the latter. As a result, when primary heating element 30 is energized in accordance with the below described operation of the present invention, interior comb 76 may be raised to a substantially elevated temperature.

Figure 4:
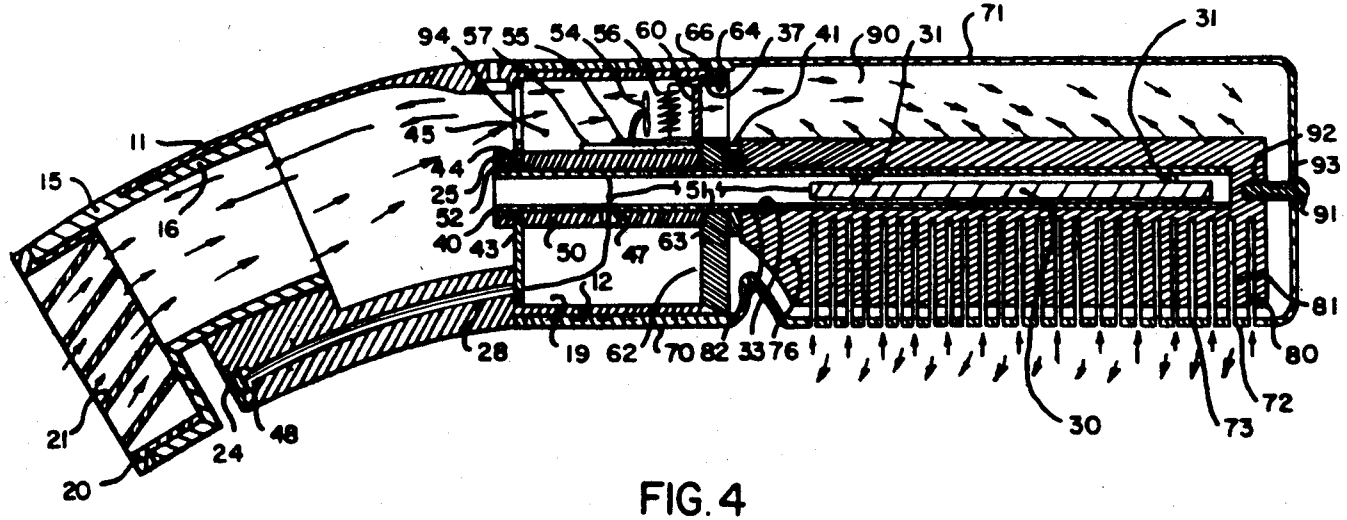
FIG. 4 is a section view of the present invention combination pressing comb and hair dryer taken along section lines 4—4 in FIG. 2.

FIG. 4 shows a complete section view of the present invention dryer comb taken along section lines 4—4 in FIG. 2. Examination of FIG. 4 shows the completed assembled structured described above in connection with Figure 1 situated within handle 11 and comb housing 70. As can be seen by examination of the section view in FIG. 4, an air path is created between serrations 80 of exterior comb 71 and serrations 73 of interior comb 76 into comb cavity 90 and through window 64 of center plate 62 into fan chamber 94 within cavity 19. The air continues through winddown 45 in plate 43 into handle cavity 14 of handle 11 and finally through louvres 21 of nozzle housing 15. As a result, operation of fan 54 in a selected direction can cause alternatively one of two air flows to be set up.

In the first air flow, by operating fan 54 in a first direction, air is drawn into comb cavity 90 through serrations 73 and 80 and passes sequentially through window 64 fan chamber 94 window 45 handle cavity 14 and is discharged through louvres 21. Conversely. with the operation of fan 54 in the alternate direction. air is drawn in through louvre 21 through handle cavity 14 then through winddown 45 into fan chamber 94 and is thereafter discharged through window 64 comb cavity 90 and exits through serrations 73 in exterior comb 71.

In either case, it is important to note that both secondary heater 56 and the heatable structure of interior comb 76 are positioned within the air flow passing through dryer comb 10. As a result, the manipulation of the selected controls 85 on control face 84 permits the degree of heat as well as direction of air flow for the present invention to be controlled. For example, with the direction of fan motor 55 selected, that air is drawn into serrations 73 and discharged through louvres 21. The present invention (pressing comb dryer) may be used to comb, dry and straighten the hair. When the air flows into serrations 73, the hair is drawn into alignment within serrations 80 of the interior of comb 76. In this operation, the heated interior of comb 76 and the suction action from air passing through serrations 80 carry the subjects hair into a substantially straight alignment and the heated comb and air flow combined provides means to dry and straighten the hair. Thus, the heated comb combined with the suction action from the air flow, sucks the moisture from the hair and the heated comb completes the drying. The pressing comb dryer, when drawn through the subject's hair, will cause the hair to be combed, dryed and straightened.

When utilized as a blow dryer, the direction of fan motor 55 is reversed such that air is drawn into louvre 21 and exits through serrations 73. In this application, a flow heated air is supplied to exit between serrations 73 for drying the hair. If desired in this application, comb 76 can be used in combination with this application for faster drying.

The comb in this mode is used in the same manner as conventional styling combs in that a blow drying action together with a combing styling action is provided by drawing the comb through the subject's hair. For example, kinky hair can be relaxed to a desired texture and tightly curled hair can be relaxed to a wavy texture by the manipulation of the selected controls 85 on control face 84 permitting the degree of heat as well as direction of air flow to be controlled.

Figures 5, 6:
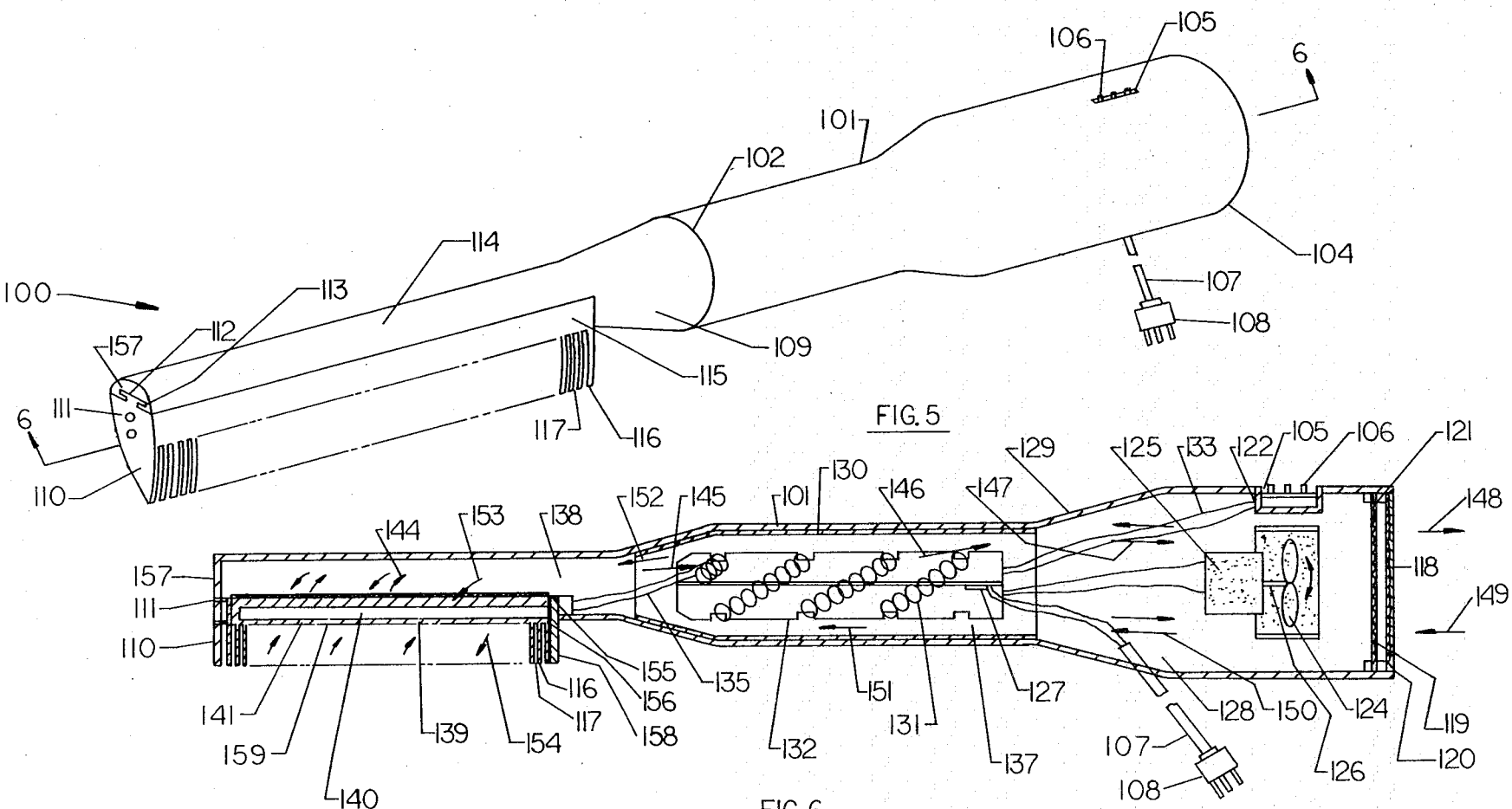
FIG. 5 is a perspective view of an alternate embodiment of the present invention combination pressing comb and hair dryer.
FIG. 6 is a section view of the alternate embodiment of the present invention combination pressing comb and hair dryer taken along section lines 6—6 in FIG. 5.

FIG. 5 shows a perspective view of an alternate embodiment of the present invention combination pressing comb and hair dryer, generally referenced by reference number 100. Pressing comb and hair dryer 100 includes a generally cylindrical handle 101 terminating in a enlarged portion 104 and a handle end 103 at one end, and a handle end 102 at the other end. A comb housing 109 defines a reduced section neck 136 and a semi-cylindrical comb support 114. Comb support 114 terminates in an end portion 157 which defines a pair of grooves 113. Comb housing 109 handle 101 and enlarged portion 104 are formed of a insulating material, such as molded plastic or the like. A slot 105 defined in enlarged portion 104 supports a switch assembly 122 (better seen in FIG. 6) which in turn supports a plurality of user operable buttons 106 which extend through slot 105 from switch assembly 122. A standard AC power cord 107 is coupled to a control board 127 (better seen in FIG. 6) at one end and a standard AC power plug 108 at the other. In accordance with conventional appliance fabrication techniques, AC cord 107 and AC plug 108 are utilized to provide a source of operative power within pressing comb and hair dryer 100. An outer comb 115 defining a plurality of teeth 116 interspaced by a plurality of slots 117, is attached, by means set forth below, to comb support 114. An end plate 110 having configuration substantially the same as teeth 116 defines a locking tongue 112 which nests within grooves 113 of comb support 114 to form an end portion of combination pressing comb and ha1r dryer 100. A pair of fasteners 111 pass through end plate 110 and secure it to pressing comb and hair dryer 100 by means set forth below in greater detail.

FIG. 6 is a section view of the embodiment of the present invention pressing comb and hair dryer set forth in FIG. 5 taken along section lines 6—6 thereof. Handle end 103 defines a recess 121 and an annular groove 120 at its extreme end remote from handle 101. A protective screen 119 is supported within groove 120. Screen 119 may be constructed either of a planar member having a plurality of air passage holes defined therein, or a wire mesh or other material mesh structure. An air vent 118 defining a plurality of air passage apertures is secured within groove 120 and comprises the outer protective member of comb and hair dryer 100 In accordance with the invention, air vent 118 may, but need not, include a plurality of air-directive vents such as vents 21 in the above-described embodiment of the present invention. Enlarged portion 104 defines therein a fan chamber 128 in which there is supported a fan shroud 123 having a generally cylindrical configuration and a fan 124. Fan 124, situated within fan shroud 123, is sufficiently smaller than the interior dimension of fan shroud 123 to permit rotation of fan 124. A fan motor 125 is supported within fan chamber 128 by conventional fabrication techniques and is coupled to a shaft 126 which in turn is coupled to fan 124 in a manner permitting rotation of fan motor 125 to drive fan 124. Handle 101 defines a narrowing diameter portion neck 129 which provides a smooth air flow transition between the reduced diameter portion of handle 101 and the enlarged portion 104 thereof. Handle 101 encloses a heating chamber 137 and terminates in a neck portion 136 at its end remote from neck 129. Heating chamber 137 includes an insulator 130 configured generally to the interior of handle 101 in the region surrounding heating chamber 137. A plurality of heating elements 131, constructed in accordance with well known appliance manufacturing techniques, are positioned within heating chamber 137 such that air flowing therethrough is caused to pass over and about heating elements 131. A heater support 132 is positioned within heating chamber 137 and supported therein in accordance with well known appliance fabrication techniques. Heater support 132 includes conductive means coupling heating elements 131 together to form an electrically coupled array of heating elements. A control board 127 is supported by heater support 132 and should be understood to include an appropriate combination of electrical elements to effectuate control of fan motor 125 and heating elements 131 and 140 through manipulation of buttons 106. Control board 127 receives electrical power from AC plug 108 via AC power cord 107 in accordance with well known fabrication techniques. Switch assembly 122, as mentioned above, supports a plurality of user operable control switches operated by buttons 106 and in similarity to the structures set forth above, is utilized to permit the user to control the functions of the present invention pressing comb and hair dryer. A plurality of wires 133 electrically couple switch assembly 122 to control board 127 and a plurality of wires 134 electrically couple fan motor 125 to control board 127. It should be understood by those skilled in the art that the electrical connections and structure set forth for heating elements 131, control board 127, switch assembly 122 and fan motor 125 are by way of example and may be carried forward in accordance with well known appliance fabrication techniques. It will be equally apparent to those skilled in the art that different electrical configurations and element configurations can be utilized without departing from the spirit and scope of the present invention. Neck 136 reduces the size of handle 101 at handle end 102 and forms an air flow transition for comb support 114. Comb support 114 defines an interior comb chamber 138 which terminates in a closed end 157. An end plate 110 is supported by end 157 and an intermediate plate 158 is attached to and supported by comb support 114. A comb body 141 defines a interior heating element passage 159 and a plurality of air passages 139. Air passages 139 pass through comb body 141 and approximate to heating element passage 159 in accordance with an important aspect of the present invention, whereby air passing through air passages 139 is heated. Comb body 141 further defines a plurality of metallic teeth 116 and a plurality of interspaced slots 117. As set forth above in the previously described embodiments of the present invention, teeth 116 are arrayed in a substantially linear arra, appropriate to permit there being drawn through the user's hair in a comb-like operation. A pair of electrically insulated stand-offs or spacers 155 and 156 are positioned between one end of comb body 141 and intermediate plate 158 to provide mechanical support for comb body 141 and attachment to intermediate plate 158 while thermally insulating intermediate plate 158 from comb body 141. A pair of fasteners 111 form an attachment between end plate 110 and the other end of comb body 141. A heating element 140 electrically coupled to heating elements 131 by a plurality of wires 135 is supported within heating element passage 159. Heating element 140 is constructed in accordance with well known appliance fabrication techniques and provides the production of heat when subjected to an electrical current.

The operation of the embodiment of the present invention pressing comb and hair dryer set forth in FIGS. 5 and 6 is essentially the same as that set forth above for the previously described embodiments. When the appropriate one of buttons 106 is operated, control board 127 causes fan motor 125 to drive fan 124 in either of two directions. In the first direction, air is drawn into air vent 118 and through screen 119 in the direction shown by arrow 149, air thereafter flows through fan chamber 128 in the direction indicated by arrow 150. The continuing flow of air passes into and through heating chamber 137 as shown by arrow 151. The passage of air through heating chamber 137 travels across heating elements 131 and acquires heat therefrom in the event heating elements 181 have been energized. The driven air then continues into comb chamber 138 and passes through air passages 139 of comb body 141 as indicated by arrow 153. Air emerging from air passages 139 as indicated by arrow 154 then passes out from comb body 141 through one or more of slots 117. Again, in the event the appropriate control has been activated and heating element has been energized, the air passing through comb body 141 and teeth 116 is further heated. Conversely, in the event the appropriate button of buttons 106 is operated by the user, fan 124 may be driven in the opposite direction as indicated by arrow 148, causing air movement in the opposite to the direction just described above. Specifically, fan 124 causes air to be drawn into comb body 141 as shown by arrow 143. The air thus drawn passes through the slots 117 between teeth 116 and air passages 139 in comb body 141 to emerge into comb chamber 138 as indicated by arrow 144. Thereafter, the air drawn by fan 124 passes into and through heating chamber 137 and across heating elements 131 as indicated by arrows 145 and 146. Once again, in the event it is desired to heat the passing hair, elements 131 are energized and heat is imparted to the air passing through heating chamber 137. In either event, the air thus drawn is pulled into fan chamber 128 in the direction shown by arrow 147 and passes out from fan chamber 128 through screen 119 and vent 118 as shown by arrow 148. In similarity to the above described embodiment, the embodiment of the present invention pressing comb and hair dryer shown in FIGS. 5 and 6 is operable in a number of combinations of heating and air movement. As a result, the embodiment shown may be operated either as a heated pressing comb in which heating element 140 is energized to heat comb body 141 and teeth 116 to provide a "hot comb" operation. Alternatively, the embodiment of the present invention combination pressing comb and hair dryer shown in FIGS. 5 and 6 may also be operated to provide functions similar to conventional hair blowers in that air drawn through comb body 141 and heating chamber 137 and discharged through vent 118 may be used as a directed stream of heated air in which the degree of heat imparted to the air is controlled by the heating of heating element 140 and heating elements 131, alone or in combination. When thus used, the present invention combination pressing comb and hair dryer provides a directed stream of relatively high vilosity heated air suitable for use in "blow drying" functions of hair styling.

As mentioned, four different devices are presently being used to style tightly curled or kinky hair. This invention combines three of these devices into one, the dryer, heating stove and pressing comb so as to eliminate overheating the hair causing damage to the latter. In styling hair, this invention allows one to bring about a healthy head of hair in a more efficient, faster, less expensive manner. In addition, many other advantages both to the clients as well as the operators.

While particular embodiments of the invention have been shown described it will be obvious to those skilled in the art that change and modifications may be made thereto without departing from the invention in its broader aspects and therefore the aim and the appended claims is to cover all such changes and modifications as fall within the true spirit and scope of the claimed invention.

What is claimed is:

1. For use in styling hair a combination pressing comb and blow dryer comprising:

an elongated housing defining a cylindrical handle portion, an enlarged end portion, a reduced end portion arranged in a substantially linear serial configuration, and a continuous internal cavity extending through said enlarged end portion, said handle portion, and said reduced end portion;

a metal comb assembly serially attached to said reduced end portion defining a first plurality of teeth, a first plurality of serrations spaced between each of said teeth in said first plurality of teeth, a heater element cavity, and a plurality of air passages;

a first heating element supported within said heating element cavity of said metal comb;

a second heating element supported within said handle portion of said internal cavity;

an electrically driven air impeller supported within said enlarged end portion of said internal cavity, said air impeller operable in a first direction in which air is drawn through said serrations, said air passages, and said internal cavity and expelled from said enlarged end portion of said housing and a second direction in which air is drawn into said enlarged portion of said elongated housing and is driven through said internal cavity and said air passages and is expelled through said serrations; and control means, supported by said elongated housing and coupled to said electrically driven air impeller and said first and second heating elements, for selectively controlling the temperature of said interior comb and said electrically driven air impeller and for individually operating said first and second heating elements.

2. A combination pressing comb and blow dryer as set forth in claim 1 wherein said internal cavity defines a fan chamber within said enlarged portion of said elongated housing and wherein said electrically driven air impeller includes:

a multi-bladed bidirectional fan rotatably supported within said fan chamber;

a reversable electric motor conductively coupled to said control means; and means mechanically coupling said multi-bladed fan to said electric motor.

3. A combination pressing comb and blow dryer as set forth in claim 2 wherein said metal comb defines a first end and a second end and wherein said combination pressing comb and blow dryer includes:

means for attaching said first and second ends of said metal comb to said reduced end portion in an insulative attachment.

4. A combination pressing comb and blow dryer as set forth in claim 3 further including:

insulating means supported within said handle portion and interposed between said second heating element and said handle portion of said elongated housing.

5. A combination pressing comb and blow dryer as set forth in claim 4 wherein said internal cavity comprises a straight-lined air flow path having a sequentially increasing cross-sectional area in said first direction of air flow.

* * * * *